United States Patent [19]

Vetovitz

[11] 4,379,380

[45] Apr. 12, 1983

[54] METHOD OF CONSTRUCTING ANGLED BRICK PANELS

[76] Inventor: William H. Vetovitz, 8174 Strongsville Blvd., Strongsville, Ohio 44136

[21] Appl. No.: 230,318

[22] Filed: Feb. 2, 1981

[51] Int. Cl.[3] ..... E04B 1/54

[52] U.S. Cl. ..... 52/259; 52/741; 403/268

[58] Field of Search ..... 52/259, 309.1, 309.5, 52/741, 744; 403/268; 264/261, 263

[56] References Cited

U.S. PATENT DOCUMENTS

| | | | |
|---|---|---|---|
| 2,392,734 | 1/1946 | Haberstump | 264/263 |
| 3,280,525 | 10/1966 | Crowley | 52/259 |
| 3,893,777 | 7/1975 | Jones | 52/259 |
| 4,004,385 | 1/1977 | Kosuge | 52/259 |
| 4,015,383 | 4/1977 | Crowley | 52/259 |
| 4,077,174 | 3/1978 | de Léaumont | 52/259 |

FOREIGN PATENT DOCUMENTS

| | | | |
|---|---|---|---|
| 2422192 | 11/1975 | Fed. Rep. of Germany | 52/259 |

*Primary Examiner*—J. Karl Bell

*Attorney, Agent, or Firm*—Body, Vickers & Daniels

[57] ABSTRACT

A method of prejoining a pair of bricks at an angle which are to be later incorporated into a prefabricated brick panel having a pair of outer surfaces at an angle other than 90° relative to each other. Either one or both ends of a pair of bricks are beveled at a total angle substantially in excess of the ultimate surface angle between the surfaces of the two adjacent bricks. The bricks are placed in a jig with the ultimate outer surfaces facing downwardly and the outer corners formed by the bevels in abutment. The V-shaped groove formed by the total angle of the bevels in excess of the ultimate angle is then filled with a cement grout which is then allowed to harden. Usually before the corners are placed in engagement, a bead of unhardened cement grout, usually colored to match the outside color of the bricks, is placed on the abutting corners.

12 Claims, 7 Drawing Figures

METHOD OF CONSTRUCTING ANGLED BRICK PANELS

This invention pertains to the art of building construction and, more particularly, to a method of constructing a prefabricated brick panel wherein the panel has two outer surfaces at an angle other than 90° relative to each other and to the article constructed by such method.

BACKGROUND

In the art of building construction, it has become conventional to construct an internal steel framework of the building and then to hoist into position prefabricated panels to form the outer skin of the building, such panels normally arranged to provide the window and door openings.

In recent years, it has become conventional to so form the individual panels that the outer surfaces are comprised of two surfaces disposed at an angle other than 90° relative to each other. At first such panels were made from precast concrete slabs. Because of the architectural beauty of bricks, it was desired to make such panels from bricks but the formation of the angle between the surfaces had been difficult to achieve while still maintaining a structurally sound panel.

It is possible to order from the brick factory bricks having the angled surfaces preformed. However, because such bricks have to be made special, there is a substantial additional cost. Furthermore, because these specially made bricks are usually fabricated at a time different than the regular bricks for the panel, matching of the color and brick texture is difficult.

THE INVENTION

The present invention contemplates a new and improved method of constructing a brick panel wherein the outer surfaces are disposed at a predetermined angle other than a right angle which is attractive in appearance, structurally sound and economical to manufacture.

In accordance with the invention, the method includes the steps of: providing a pair of bricks having outer surfaces to be disposed at a predetermined angle relative to each other; beveling the end of at least one of the bricks at an angle such that when said bricks are positioned relative to each other at the predetermined angle and with the outer corners in contact, the inner corners will be spaced a distance apart of approximately $1\frac{1}{2}$ to $2\frac{1}{2}$ inches with the maximum bevel angle of either brick not exceeding 55°; positioning said bricks with the outer surfaces at said predetermined angle with the outer corners in contact and the space formed by the bevel(s) preferably facing upwardly and exposed; filling the space with cement; and, allowing the cement to harden. For a standard brick width of $3\frac{5}{8}$ inches and with a predetermined outer surface angle of 0° (i.e. a flat surface), to produce a 2 inch spacing between the inner corners of the bricks requires a total bevel angle of 30°. This total bevel angle may be provided by beveling the end of one brick at the 30° angle and leaving the end of the other brick untouched or the total angle may be divided between the two bricks and if so, preferably equally, namely 15°. The total bevel angle in accordance with the invention will thus equal 30° plus the predetermined surface angle between the two bricks. The bevel angle on any one brick should not exceed 55°.

Thus, if the predetermined angle is in excess of about 30°, then the ends of both bricks should be beveled.

Standard bricks also include a plurality, e.g. five, transverse openings through the large side of the bricks and in accordance with the invention, the bevel cut preferably passes through one of such openings, either on the diameter or preferably close thereto.

Further in accordance with the invention, the pair of bricks to be joined with the predetermined surface angle are positioned in side-by-side relationship with other similar pairs of bricks with a space in between of a type to which the hardened cement will not adhere.

Further in accordance with the invention, the beveled surface(s) is(are) coated with a cement bonding material prior to the application of the cement.

Further in accordance with the invention, prior to positioning the outer corners of the bricks in engagement with each other, a bead of cement is placed on at least one of the corners to be abutted of a color matching the color of the brick such that if the corner between the two surfaces is damaged or does not exactly fit, the flaw will not be noticeable except upon close inspection.

The invention further comprises the additional step of progressively laying bricks including at one point the joined bricks in end-to-end relationship on their sides and in a plurality of vertically stacked layers with cement between the ends of bricks and between each layer until the panel has reached its desired height which will become the width of the panel when ultimately installed.

Further, the invention contemplates inserting rods through vertically aligned openings in the bricks of each layer and grouting such rods in place so as to provide a structurally sound and strong panel which can be easily shipped to the job site and hoisted into its final assembled position. Horizontal joint reinforcing is also placed between layers bridging the cement between the brick ends.

OBJECTS

The principal object of the invention is the provision of a new and improved method of joining a pair of bricks with the outer surfaces disposed at an angle other than a right angle which provides a structurally sound and essentially continuous brick surface through the angle.

Another object of the invention is the provision of a new and improved method of joining a pair of bricks so that the outer surfaces will be at an angle wherein there will be no apparent joint where the bricks are joined and if there are any flaws, they will not be visible or apparent except upon a very close inspection.

Another object of the invention is the provision of a new and improved method of constructing a brick panel wherein the outer surfaces are at an angle relative to each other which enables the panel to be economically constructed at a point remote from the ultimate job site and then transported to the job site and hoisted into position.

DRAWINGS

The invention may take form in certain steps and combinations of steps and certain parts and combinations of parts, a preferred embodiment of which will be described in this specification and illustrated in the accompanying drawings which form a part hereof and wherein.

PREFERRED EMBODIMENT

Figure 1:
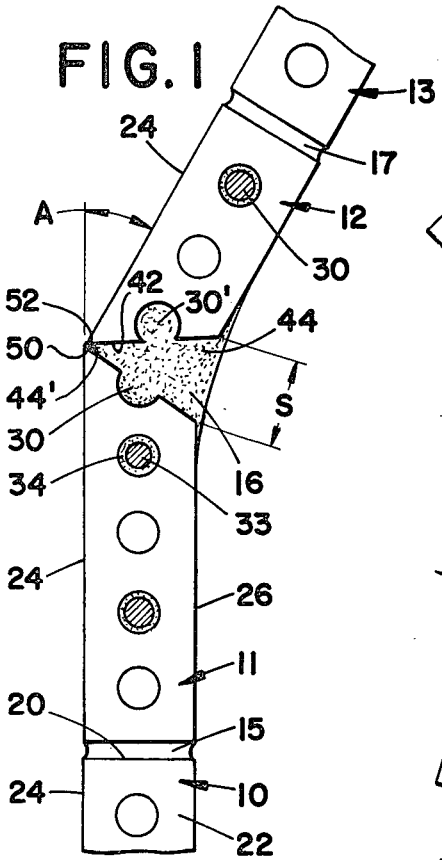
FIG. 1 is a fragmentary vertical cross sectional view of a brick panel embodying the invention and constructed in accordance with the method of the invention.

Referring now to the drawings wherein the showings are for the purposes of illustrating a preferred embodiment of the invention only and not for the purposes of limiting same, FIG. 1 shows a side view of a brick panel comprised of bricks 10, 11, 12 and 13 disposed essentially in end-to-end relationship with cement 15 between bricks 10 and 11, cement 16 between bricks 11 and 12 and cement 17 between bricks 12 and 13. While not shown, in the finished panel there are additional layers of vertically extending rows of bricks with the cement joints staggered relative to the cement in the joints shown in FIG. 1.

The bricks 10, 11, 12, 13 are standard bricks and are normally 2¼ to 4 inches wide, 3⅝ inches thick and 12 inches long and have end surfaces 20, large side surfaces 22, an outer surface 24 and an inner surface 26. Each 12 inch long brick is normally provided with five openings 30 extending transversely through the sides 22 and in a given panel, the openings 30 in adjacent layers of the panel are horizontally aligned. In the preferred embodiment, metal rods 33 extend through at least some of these openings and are rigidly held in position by grout 34. Bricks 10 and 13 are identical. Metal reinforcing (not shown) is provided between adjacent layers.

In accordance with the invention, brick 11 has its upper end 40 and brick 12 has its lower end 42 beveled at an angle with the V-shaped space between the beveled end 40, 42 filled with a hardened cement 44. The beveled surface 40 generally passes through one of the openings 30 in brick 11 and also forms an upper outer corner 50 with outer surface 24 while the beveled surface 42 passes through one of the transverse openings 30 in brick 12 and forms a lower outer corner 52 with outer surface 24.

The outer surface 24 of brick 11 is at an angle A other than 90° relative to the outer surface 24 of brick 12, which angle is predetermined by the architectural requirements of the building and will hereinafter be referred to as the surface angle. In the embodiment shown, the surface angle A is 30°. Obviously it can be any angle from 0 up to approximately 90°.

In the embodiment shown, the outer upper corner 50 of brick 11 is in physical contact with the outer lower corner 52 of brick 12 and at least immediately adjacent the intersection of these corners, the cement 44' is preferably colored the same color as that of the bricks 11, 12.

In accordance with the invention, the inner adjacent corners of bricks 11, 12 are spaced a distance apart S of between 1½ to 2½ inches and preferably 2 inches, such that when the bricks 11, 12 are positioned at the angle shown and with corners 50, 52 in engagement, there will be ample room to force the cement 44 into the V-shaped gap in the cut openings 30' provided by the beveling which gap has its apex at the engaging corners 40, 42.

Figure 2A:
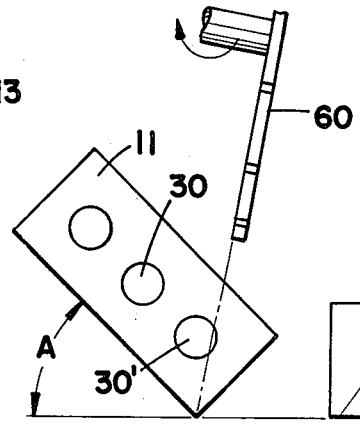
FIG. 2A is a similar view when the angle is greater than 30°.
Figure 2A:
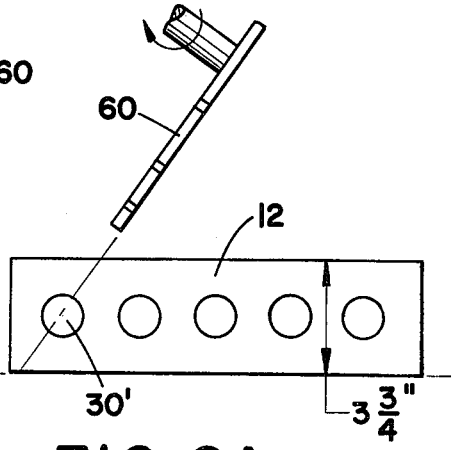
Figure 2:
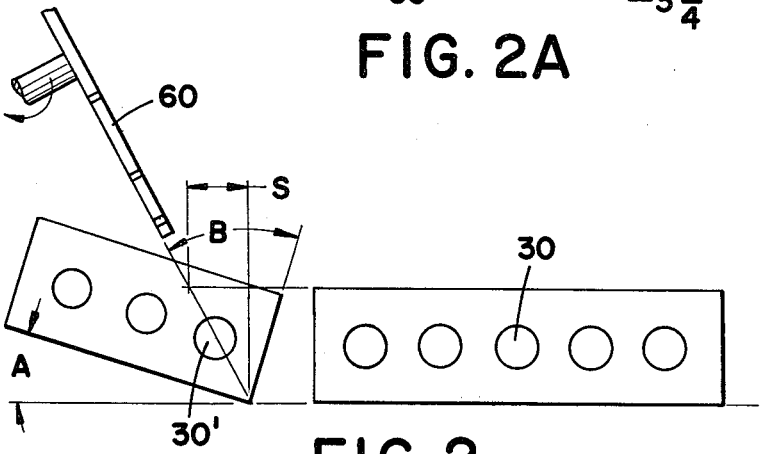
FIG. 2 is a schematic view showing a pair of bricks disposed relative to cutting saws for the purpose of beveling the ends thereof when the predetermined angle is less than 30°.
Figure 3:
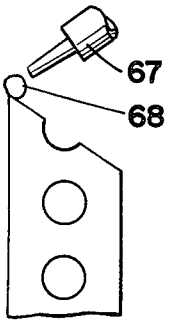
FIG. 3 is a schematic view showing the application of colored cement to the outer corner of the brick.

FIGS. 2 and 2A show the first step in the method of manufacturing of the panel shown in FIG. 1. Thus, a cutting saw 60 is provided to bevel the end of either brick 11 or brick 12 or both, depending on the surface angle A desired in the ultimate panel.

To provide a distance S equal to 1.5, 2 or 2.5 inches with a surface angle of 0° and with a standard 3⅝ inch thick brick, the total bevel angle B calculates to be about 22°, 28° and 34° respectively. This bevel angle B may be taken on either brick 11 or brick 12 or may be divided in any desired way between bricks 11 and 12 but if it is divided, it is divided preferably equally. In order to avoid the expense of beveling both ends, when the surface angle A approaches 30°, the distance S is allowed to approach the minimum of 1.5 inches. For a surface angle A in excess of 30°, both bricks should be beveled equally.

For a distance S equal to 2 inches, a total bevel angle B of 28° is required which must be increased by the surface angle A of the bricks. If the surface angle is to be 10°, there must be a total bevel angle of 38°. If the surface angle A is 30°, there must be a total bevel angle B of 58°. It is preferred that the bevel angle of any one brick not exceed 55°. If the total bevel angle B between two bricks is to exceed 55°, then in accordance with the invention, the ends of both bricks should be beveled. As indicated, the beveling may be divided in any desired way between the two adjacent bricks but preferably the bevel angle is equally divided.

The next step in the method is to coat the beveled end of the bricks 11, 12 with a cement bonding material 65. A preferred material employed is a proprietary formula sold under the trademark "Thorobond".

After coating the beveled ends of the bricks, they are preferably placed in side-by-side abutting relation ship with the sharp corner formed by the bevel facing upwardly and by means of an extrusion gun 67 a cement 68, preferably colored to match the color of the brick, is deposited on the sharp upper corner.

Figure 4:
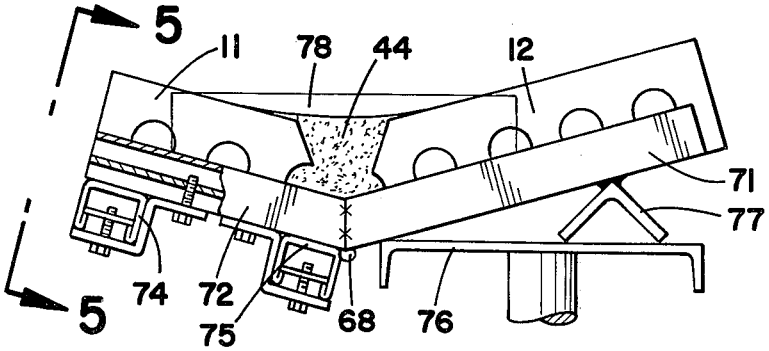
FIG. 4 is a view of the brick disposed in a jig with the outer surfaces at the desired outer surface angle and with the cement in position.
Figure 5:
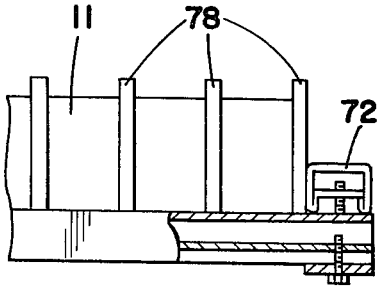
FIG. 5 is a view of FIG. 4 partly broken away taken on the line 5—5 thereof; and, FIG. 6 is a view similar to FIG. 4 but showing the completed pair of joined bricks.
Figure 6:
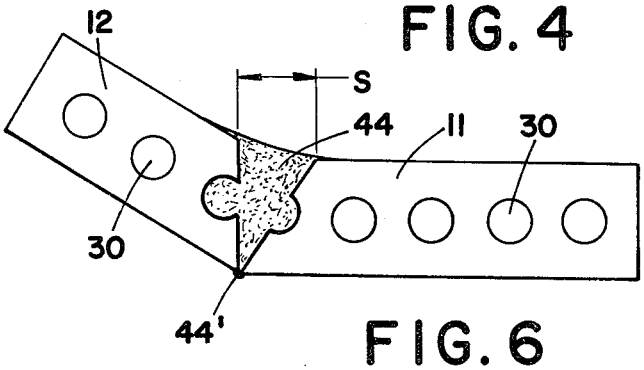

FIG. 4 shows the next step. In this step a jig is provided which is comprised of a pair of parallel extending, upwardly facing supporting surfaces disposed at the desired surface angle of the panel. This jig may be made adjustable but normally is rigidly constructed for each job and is comprised of a pair of end members 70 each having a pair of arms 71, 72 disposed at an angle relative to each other equal to the desired surface angle A and horizontal members 73, 74, 75, 76 extending below and between such end members 70 providing supporting surfaces at the desired angle A. The bricks 11, 12 are positioned on such surfaces with their outer surfaces 24 facing downwardly and with the corners 40, 42 with the cement 68 thereon in abutting relationship. Pairs of such bricks 11, 12 are placed in side-by-side relationship with spacer members 78 therebetween. The spacer member 78 has a lower edge cut to the surface angle A and has the characteristic that the cement will not rigidly adhere thereto so that when the cement hardens or at least partially hardens, the spacer member can be broken away leaving the bricks 11, 12 in rigidly joined relationship.

Once the bricks are so placed, a conventional quick setting cement 44 is placed in the upwardly diverging opening, preferably in an amount such that its upper surface overlaps the inner surface 26 of the bricks 11, 12. Normally the cement will be smoothly feathered into the surfaces of the bricks generally as is shown.

The members 73, 74, 75, 76 of the jig may be of any length depending upon the member of bricks 11, 12 to be joined at the desired angle. It will also be noted that the cement is forced into the openings 30 which have been intersected by the beveling of the ends of the bricks 11, 12.

The cement is then allowed to harden to a strength sufficient for handling. The assembled bricks may then be removed from the jig. Any burr of the cement extending beyond the corners 40, 42 can be readily brushed away leaving a smooth uninterrupted brick surface between bricks 11, 12 around the outwardly facing corner.

Once a plurality of bricks 11, 12 have been joined as above described, the brick panel shown in FIG. 1 can be constructed using conventional brick laying techniques. In such an operation, it is preferred that the cement joints 15 and 17 of adjacent layers be staggered as is conventional in the construction of brick panels. Also openings 30 in adjacent layers are aligned. Alternatively, the joints are aligned all as required by the architect.

Once the required number of layers of bricks 10, 11, 12, 13 have been laid to provide a panel of the desired height or width when ultimately installed, metallic rods 33 of a diameter less than the diameter of the openings 30 are inserted through the aligned openings and the space between the rods and the inner walls of the openings 30 are then grouted with grout 34.

The entire assembled panel is then allowed to rest in place until the cement has thoroughly hardened at which time the panels can be transported either to storage or to the ultimate job site and hoisted into position.

For the purposes of simplicity the bonding material placed in the notch or between adjacent bricks has been referred to generically as "cement" meaning at all times a plastic or flowable mass until hardening. Such a cement is otherwise known as "cement grout" or "cement mortar" as such terms are used in the art.

The invention has been described in connection with a preferred embodiment. Obviously modifications and alterations will occur to others upon a reading and understanding of this specification and it is my intention to include all such modifications and alterations insofar as they come within the scope of the appended claims.

Having thus described my invention, I claim:

1. A method of joining a pair of bricks so as to have outer surfaces disposed at a predetermined surface angle to each other comprising the steps of: beveling the end of at least one of the bricks at an angle such that when said bricks are positioned relative to each other at the predetermined angle with the outer corners in contact, the inner corners will be spaced a distance of approximately $1\frac{1}{2}$ to $2\frac{1}{2}$ inches with the maximum bevel angle on any one brick not exceeding about 55°; positioning said bricks with their outer surfaces disposed at said predetermined angle facing downwardly with their outer corners in abutting engagement to define an upwardly facing V-shaped notch; filling said V-shaped notch with a cement; and allowing said cement to harden.

2. The method of claim 1 wherein at least the base of said V-shaped notch is first filled with a cement colored to match the color of the brick.

3. The method of claim 1 wherein said bricks have transverse openings therethrough and said beveled end extends through one of said openings.

4. The method of claim 1 wherein said beveled end is coated with a cement bonding material prior to filling said V-shaped notch with cement.

5. The method of claim 1 including the step of depositing a bead of colored cement on the sharp corner formed by said beveling with the outer surface prior to placing said bricks in said jig.

6. The method of claim 1 including the additional step of positioning said joined bricks in horizontal rows with other bricks and in a plurality of vertical layers with cement therebetween to a height of the desired width of the ultimate panel.

7. The method of claim 6 wherein said bricks have transverse openings and including the steps of: vertically aligning the openings of adjacent layers; inserting a reinforcing rod of a diameter smaller than said openings through said aligned openings; and, grouting in the space between said rod and said openings.

8. A method of joining bricks at an angle to be later incorporated into a prefabricated brick panel having a pair of outer surfaces at a surface angle of between 0° and 90° relative to each other comprising the steps of:

(a) providing a pair of rectangular bricks, each having a pair of end surfaces, a pair of side surfaces and an inner and an outer surface, said end surfaces and said front surfaces forming a corner;

(b) beveling the end of at least one brick at an angle of at least 10° in excess of said surface angle but not greater than a total of 55° to provide at least one beveled end surface forming an acute angled corner with the outer surface of said brick;

(c) placing a bead of unhardened cement on at least one corner formed by an outer surface and an end surface;

(d) placing said pair of bricks with said outer surfaces at said surface angle and said corners in substantial abutment whereby said bead is at least partially deformed;

(e) said end surfaces diverging at an angle equal to the total angle of the bevel angle minus the surface angle to form an upwardly facing V-shaped groove, the apex of which is formed by said unhardened cement and said abutting corners;

(f) placing a barrier in engagement with said side surfaces and bridging said groove;

(g) filling said groove with unhardened cement; and, (h) allowing said cement to harden.

9. The method of claim 8 wherein said bricks have a width between said inner and outer surfaces of approximately $3\frac{5}{8}$ inches and the V-shaped groove has a width of approximately $1\frac{1}{2}$ to $2\frac{1}{2}$ inches.

10. The method of claim 8 wherein said bricks have a plurality of transverse openings through said side surfaces and said beveled surface extends through one of said transverse openings.

11. The method of claim 8 wherein said bricks have a thickness between the inner and outer surfaces of approximately $3\frac{5}{8}$ inches and said surface angle is greater than 30° the method including the step of beveling the ends of both bricks with the sum of the angles of the two bevels being equal to the surface angle plus at least 25°.

12. A pair of bricks in end-to-end engaging relationship and having their outer surfaces disposed at an angle other than 90° relative to each other, the adjacent end of at least one of said bricks being beveled at an angle such that if the brick has a standard width of $3\frac{5}{8}$ inches and the outer corners are engaging, the inner corners will be spaced a distance apart of between $1\frac{1}{2}$ and $2\frac{1}{2}$ inches and hardened cement filling the space between the end surfaces.

* * * * *